US005722189A

United States Patent [19]

Johnson

[11] Patent Number: 5,722,189

[45] Date of Patent: Mar. 3, 1998

[54] ATHLETIC SHOE SOLE COVERING

[76] Inventor: Ron D. Johnson, 1851 Gibbs Shoals Rd., Greer, S.C. 29650

[21] Appl. No.: 599,069

[22] Filed: Feb. 9, 1996

[51] Int. Cl.[6] ..... A43B 5/00

[52] U.S. Cl. ..... 36/135; 36/7.5; 36/127

[58] Field of Search ..... 36/7.1 R, 7.5, 36/11.5, 127, 135

[56] References Cited

U.S. PATENT DOCUMENTS

| | | | |
|---|---|---|---|
| 1,749,351 | 3/1930 | McQueen . | |
| 3,020,654 | 2/1962 | McCann . | |
| 3,243,902 | 4/1966 | Chapman . | |
| 3,313,047 | 4/1967 | Svien | 36/135 |
| 3,566,488 | 3/1971 | Pilarski | 36/7.5 |
| 3,964,180 | 6/1976 | Cortese . | |
| 4,145,055 | 3/1979 | O'Brien . | |
| 4,326,345 | 4/1982 | Sbicca | 36/135 |
| 4,693,019 | 9/1987 | Kim . | |
| 5,070,631 | 12/1991 | Fenton . | |
| 5,172,496 | 12/1992 | Vemi . | |
| 5,197,210 | 3/1993 | Sink . | |
| 5,305,536 | 4/1994 | Depping | 36/135 |

OTHER PUBLICATIONS

Austand's Golf Catalog, Summer, 1996.

*Primary Examiner*—M. D. Patterson
*Attorney, Agent, or Firm*—Dority & Manning

[57] ABSTRACT

A removable bottom covering is provided for spiked athletic shoes, particularly golf shoes. A flexible sole member has a toe section, a heel section, and an intermediate section between the toe and heel sections. A plurality of magnetic attaching members are disposed in the toe and heel sections and are arranged in a pattern and have a recess or well so as to accommodate and attach to metallic spikes of the athletic shoe. An area of reduced thickness is defined in the flexible sole member between the toe and heel sections. The area of reduced thickness has a shape and depth so as to accommodate the remaining spikes of the athletic shoe.

8 Claims, 2 Drawing Sheets

ATHLETIC SHOE SOLE COVERING

BACKGROUND OF THE INVENTION

The present invention relates to a removable covering for an athletic shoe, and particularly to a removable sole covering for a golf shoe.

Various types of athletic shoes incorporate metallic spikes on the bottom of the soles to increase traction of the shoe. For example, golf shoes or golf spikes include metallic spikes arranged in a pattern on the bottom of the shoe. Unfortunately, the golf spikes can present several problems.

For example, golf clubhouses experience wear and tear because of golf spikes worn inside their facilities. This includes damage to carpeting, tiled floors, wooden floors, brick entrances, door sills, and the like. The clubs may attempt to control this problem by restricting the wearing of golf spikes inside of the facilities. The clubs are, however, basically unsuccessful in solving the problem since golfers need access to most areas of the clubhouse before, during, and after playing when they are wearing their spikes.

The wearing of golf spikes on hard surfaces can also be a substantial safety issue for public courses and hotels. The metal spikes are extremely unstable on hard surfaces such as concrete, bricks, tile, or stone.

Golfers wear spikes to maximize traction on the golf course. However, the wearing of spikes on sidewalks, parking lots, paved driveways, and any other hard or abrasive surfaces causes premature wear of the spikes. This requires periodic premature replacement of the spikes in order to maintain their function.

Also, when golfers go to the golf course, they typically change their shoes either in their open car trunks in the parking lot or in the locker room of the club facilities. Either method is awkward and cumbersome. The parking lot change is uncomfortable and undignified. If shoes are left in the locker room from one round to the next, a golfer must retrieve them if he decides to play another course. In any event, the handling and changing of street shoes and golf shoes is one of golf's unpleasant experiences.

Additionally, when golfers travel with their clubs and equipment, golf shoes can present particular problems. The open-faced spikes are a dilemma for any piece of luggage. The golf spikes are hard to pack and can damage anything they come in contact with, particularly the luggage.

Various attempts have been made in the art to overcome the problems noted above. For example, U.S. Pat. No. 3,020,654 to McCann describes an auxiliary sole for sport shoes, and particularly golf shoes. U.S. Pat. No. 5,070,631 to Fenton describes a golf shoe cleat cover having gripping members which are slidably held within channels of the cover. U.S. Pat. No. 3,243,902 to Chapman describes another protective sole for spiked shoes. U.S. Pat. No. 4,693,019 describes a sports shoe protector having a sole and a means for securing the sole to support shoes having spikes.

OBJECTS AND SUMMARY OF THE INVENTION

It is a principal object of the present invention to provide an improved athletic shoe removable cover.

An additional object of the present invention is to provide a removable sole member for golf shoes.

Still another object of the present invention is to provide a spiked athletic shoe removable covering which is reliably held on the golf shoe yet easy to remove and apply to the golf shoe.

Additional objects and advantages of the invention will be set forth in part in the following description, or may be obvious from the description, or may be learned through practice of the invention.

In accordance with the objects and purposes of the invention, a removable bottom covering is provided for a spiked athletic shoe, such as a golf shoe. The bottom covering includes a flexible sole member having a given thickness and defining an upper surface and a bottom surface. The flexible sole member has a toe section, a heel section, and an intermediate section between the toe and heel sections. A plurality of magnetic attaching members are disposed in recesses defined in the heel section and recesses defined in the toe section. The magnetic attaching members are arranged in a pattern and have a recess or well so as to accommodate and attach to metallic spikes in the toe and heel sections of an athletic shoe. The magnetic attaching members have an upper face which is disposed essentially flush with the flexible sole upper surface. An area of reduced thickness is defined in the flexible sole member between the toe section and the heel section. This area of reduced thickness has a shape and depth so as to accommodate the remaining spikes of the athletic shoe once the covering is placed on the bottom or sole of an athletic shoe.

Preferably, the flexible sole member has a flexibility so as to conform to changing contours of the athletic shoe when worn. The flexible sole member may be formed of any manner of conventional materials, such as foam rubber, rubber material, neoprene, polyurethane, a urethane blend, or the like. Also, the flexible sole preferably comprises a traction enhancing bottom surface, such as a ridged or orange-peel surface. The flexible sole member may comprise a plurality of layers of flexible material adhered together. In this embodiment, the area of reduced thickness may comprise cut-out portions of upper layers of the flexible material.

The magnetic attaching members comprise circular magnets, preferably rare earth magnets, and include metallic backing plates. The magnets and backing plates are disposed in correspondingly sized recesses or holes defined in the flexible sole member. The magnets further include an upper magnetic face which is disposed generally flush with the flexible sole member upper surface. The magnetic sole face attaches to the metallic face of conventional golf shoe spikes. The magnetic face may also be angled or contoured so as to generally match the shape or angle of the metallic faces of conventional golf shoe spikes.

In a preferred embodiment, the athletic shoe covering comprises a generally continuous outer circumferential edge having a generally uniform height therearound. This provides the shoe and covering with an overall pleasing aesthetic appearance. In this embodiment, the area of reduced thickness of the flexible sole member is defined within the continuous outer circumferential edge, and may include, for example, longitudinally extending recesses defined in the flexible sole member extending from the toe section to the heel section.

In an alternative preferred embodiment, the athletic shoe covering comprises a toe grip section, preferably formed integral with the flexible sole member. The toe grip section extends above the sole member and provides a means for a wearer of the device to insert the shoe toe section so as to more positively hold the device to the athletic shoe. This will prevent the shoe covering from inadvertently detaching from the shoe if it is caught on a surface, for example when the wearer of the device is walking up stairs. The toe grip section may be formed from the same material as the flexible sole member, or may comprise any other type of suitable material. The toe grip section may be molded directly with the sole member, or may be attached to the sole member in any conventional manner.

The invention is explained in detail below through the aid of the attached drawings.

DETAILED DESCRIPTION OF THE PREFERRED EMBODIMENTS

Figure 1:
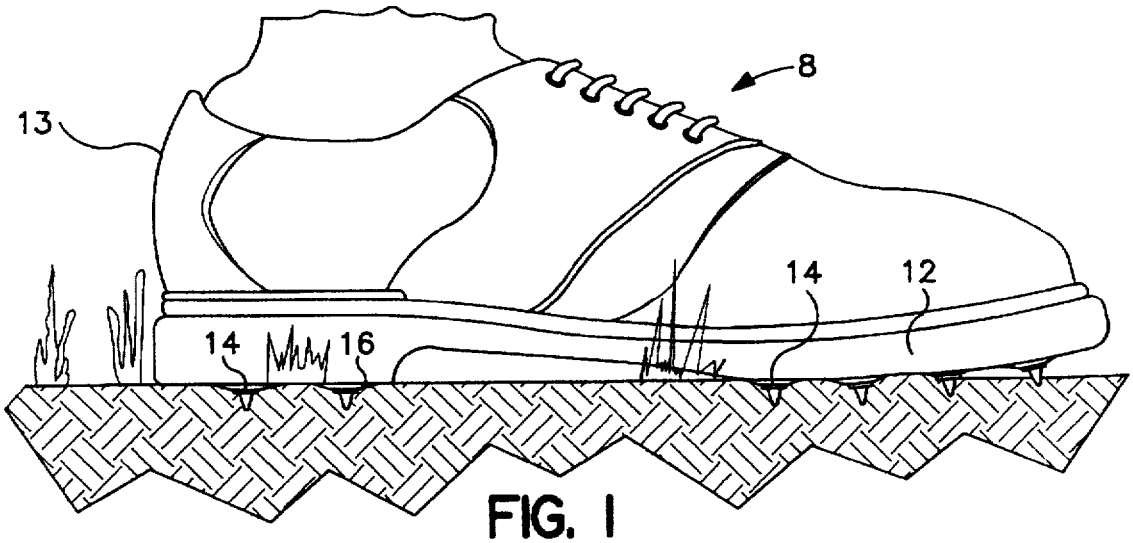
FIG. 1 is a perspective view of a conventional athletic shoe, particularly a golf shoe or golf spike.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. The numbering of components in the drawings is consistent throughout the application, with the same components having the same number in each of the drawings.

The present inventions relates to a removable bottom covering for spiked athletic shoes. The present invention is not limited to any particular type of athletic shoe and can be used on baseball cleats, track shoes, and any other manner of athletic shoes having metallic spikes attached to the bottom sole. For purposes of illustration and explanation of the invention, the removable bottom covering is shown and described associated with conventional golf spikes. For example, referring particularly to FIG. 1, a conventional golf shoe 8 is illustrated. The golf spike includes an upper shoe portion 13 and a sole 12 attached thereto. Golf shoe 8 includes a plurality of metal spikes 14 protruding from sole 12, as is commonly understood in the art. Spikes 14 may also include a metallic facing plate or member 16 which generally surrounds spike 14.

Figure 2:
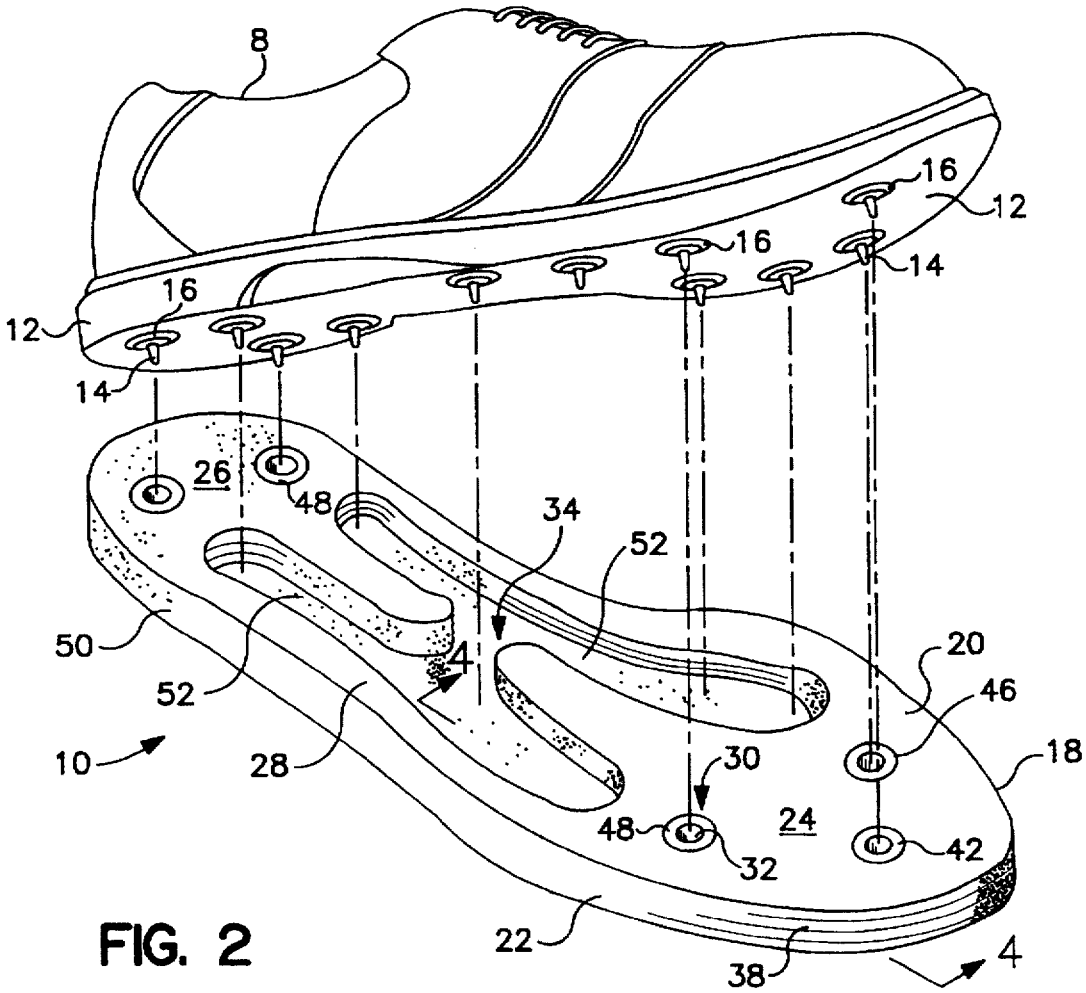
FIG. 2 is a perspective view of the athletic shoe covering according to the invention shown as it would attach to the golf shoe of FIG. 1.

Referring particularly to FIG. 2, the present invention includes an athletic shoe covering, generally 10. Covering 10 includes a flexible sole member 18, which is adapted in size to generally fit on the bottom sole 12 of golf shoe 8.

Flexible sole member 18 is formed of any manner of conventional flexible material, such as rubber material, foam rubber, neoprene, polyurethane, a urethane blend, and the like. Sole member 18 has a flexibility so as to bend and conform to the contours of golf shoe 8, particularly when the golf shoe is worn and used. The material of sole member 18 is flexible in that the overall sole member will bend and conform to the bottom sole of shoe 8, and is preferably spongy or resilient enough to provide a cushioning effect while maintaining its overall shape.

Flexible sole member 18 may be formed from a single piece of material, such as a sheet of foam rubber, and can be stamped or cut out of the material by any conventional manner. Sole member 18 has a depth or thickness to at least accommodate the length of spikes 14, as will be discussed further on. Sole member 18 also preferably includes a continuous outer circumferential edge 50 to give the covering an overall pleasing aesthetic appearance.

In an alternative embodiment, sole member 18 may be formed by layers 38 of flexible material which are adhered or glued together.

Flexible sole member 18 defines an upper surface 20 and a bottom surface 22. Sole member 18 includes a toe section 24, a heel section 26, and an intermediate section 28 defined between the toe and heel sections. Referring particularly to FIG. 2, a plurality of magnetic attaching members, generally 30, are provided in toe section 24 and heel section 26. The magnetic attaching members define a recess or well 32 to accept or accommodate spikes 14. In the embodiment illustrated, three magnetic attaching members 30 are provided in the toe section 24 and two such members are provided in the heel section 26. The magnetic attaching members 30 are disposed in correspondingly sized recesses 46 defined in flexible sole member 18. Magnetic attaching members 30 are defined in a pattern which corresponds to the pattern of spikes 14 of the golf shoe 8. It should be understood that the number of magnetic attaching members 30 provided in the toe and heel sections 24, 26, depends on the spike pattern of spikes 14 in shoe 8 and the magnetic attraction forces required to keep covering 10 attached to shoe 8.

Figure 4:
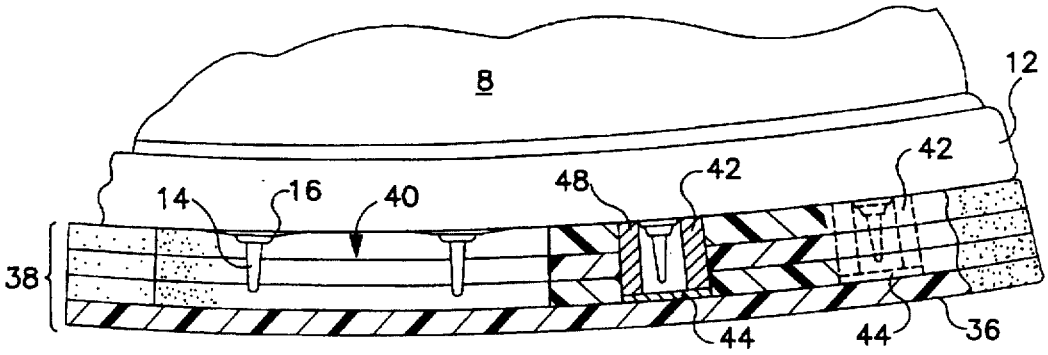
FIG. 4 is a partial cut-away view of the covering assembled with the golf shoe.

In a preferred embodiment, magnetic attaching members 30 comprise circular magnets 42. Magnets 42 preferably comprise rare earth magnets, but may include any conventional magnet. Referring particularly to FIG. 4, magnets 42 are generally cylindrical and include a metallic backing plate 44 disposed opposite the open recess 32 of magnets 42. Metallic backing plate 44 tends to prevent leakage of the magnetic flux pattern and concentrates the magnetic force within well or recess 32. The backing plates increase the holding force of magnets 42 so that a lesser amount of attaching members 30 are necessary to hold covering 10 to the shoe. For example, an embodiment tested by applicant and illustrated in the figures requires only five magnets 42 to adequately hold covering 10 to the shoe. Magnets 42 also preferably include an upper magnetic face 48 which is disposed flush with flexible sole member 18. Magnetic face 48 attaches to the metallic face plates 16 of conventional golf spikes 14. In this regard, upper magnetic faces 48 may be contoured or angled so as to correspond to the shape of metallic face plates 16.

An area of reduced thickness 34 is provided in intermediate section 28 between toe section 24 and heel section 26. This area of reduced thickness 34 can comprise any manner of pattern or construction. For example, in the embodiment wherein sole member 18 is formed by layers of flexible material 38, reduced thickness area 34 can comprise cut-out sections or portions of the upper layers of sole member 18. In the embodiment wherein sole member 18 is formed from a single piece of material, reduced thickness area 34 can be formed in the material by any conventional manner. Reduced thickness area 34 provides sole member 18 with greater flexibility characteristics thereby allowing sole member 18 to more easily conform and flex with golf shoe 8. Reduced thickness area 34 is defined in a pattern and has a depth so as to accommodate the remaining spikes 14 of golf shoe 8, as particularly seen in FIG. 4. In a preferred embodiment illustrated in FIG. 2, area 34 comprises longitudinal sections 52 defined on each side of sole 18 from toe section 24 to heel section 26. The longitudinal recesses 52 provide sole member 18 with greater overall longitudinal flexibility. However, it should be understood that reduced thickness area 34 or cut-out section 40 can be defined in any manner within sole member 18. The holding strength of magnets 42, particularly rare earth magnets, combined with backing plates 44 allows for a lesser amount of magnets and thereby allows for the area of reduced thickness to be defined in sole member 18 greatly increasing the flexibility of sole member 18.

Figure 3:
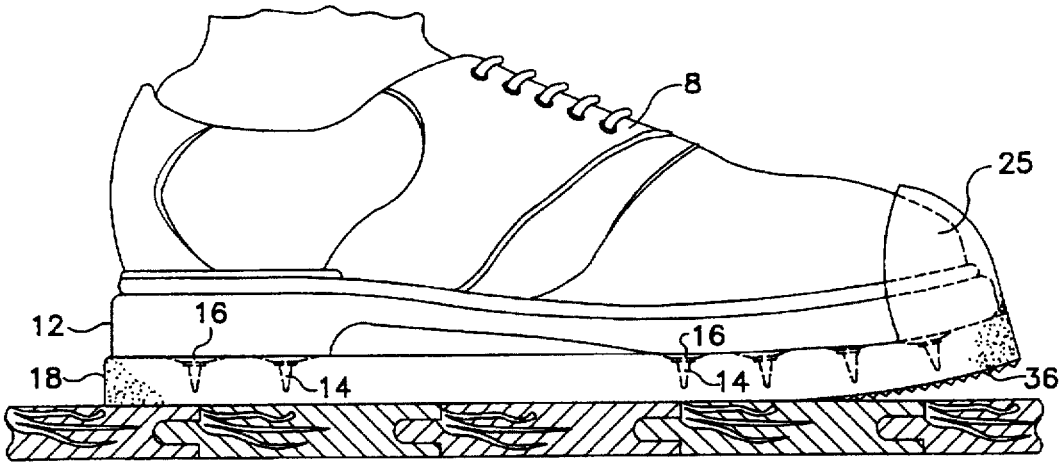
FIG. 3 is a perspective view of the covering according to FIG. 2*a* attached to the conventional golf shoe.

Preferably, the bottom surface 22 of sole member 18 includes a traction enhancing surface 36, as particularly seen in FIG. 3. Traction enhancing surface 36 can comprise any manner of shape or design, such as ridges, orange-peel surface, or the like. Additionally, although not illustrated in the figures, traction enhancing surface 36 may comprise a separate surface or material which is adhered or otherwise attached to flexible sole member 18.

Figure 2A:
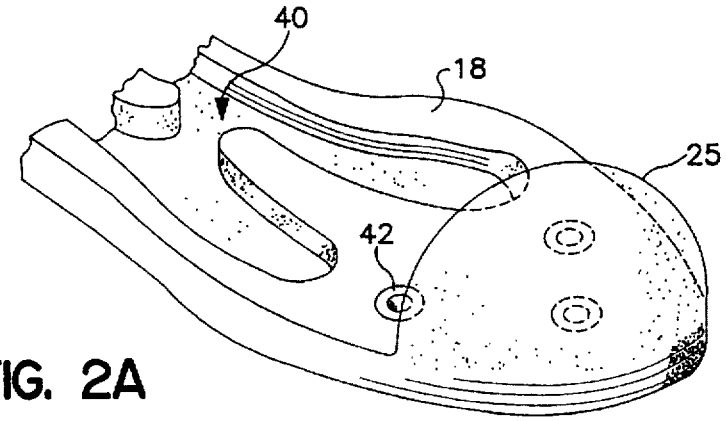
FIG. 2*a* is an enlarged perspective view of the toe section of an alternative embodiment of the invention.

An alternative preferred embodiment of covering 10 is particularly illustrated in FIGS. 2*a* and 3. In this embodiment, a toe grip section 25 is attached to flexible sole member 18. For example, toe grip section 25 may be molded integrally with sole member 18, or can be attached by any conventional manner. Toe grip section 18 has a shape and configuration whereby the wearer of covering 10 can easily slip the toe section of his shoe into toe grip section 25. Toe grip section 25 ensures that covering 10 will remain attached to the shoe even if the wearer accidently catches covering 10, for example when walking up stairs. Toe grip section 25 can be formed of any manner of conventional material, for example the same material forming sole member 18, and need extend longitudinally only to the extent that it will grip the toe section of a shoe.

It should be apparent to those skilled in the art that various modifications and variations can be made in the present invention without departing from the scope or spirit of the invention. It is intended that the present application include such modifications and variations as come within the scope of the appended claims and their equivalents.

What is claimed is:

1. A covering for a spiked athletic shoe, comprising:

a flexible sole member of a given thickness with an upper surface and a bottom grip enhancing surface, said flexible sole member having a toe section, a heel section, and an intermediate section between said toe and heel sections;

a plurality of magnets disposed in said heel section and a plurality of magnets disposed in said toe section, said magnets defining openings so as to accommodate and attach to metallic spikes in toe and heel sections of a spiked athletic shoe, said magnets further comprising an upper magnetic face generally flush with said flexible sole member upper surface;

individual unconnected metallic backing plates attached to each of said magnets opposite said openings; and at least one cut out section defined in said flexible sole member between said toe section and said heel, said cut out section having a depth so as to accommodate spikes of an athletic shoe and to provide said flexible sole member with a flexibility so as to conform with changing contours of a golf shoe when worn by a person.

2. The covering as in claim 1, wherein said bottom surface of said flexible sole comprises a traction enhancing surface.

3. The covering as in claim 1, wherein said flexible sole member comprises a plurality of layers of flexible material adhered together, said area of reduced thickness comprising cut out portions of upper said layers of flexible material.

4. The covering as in claim 1, wherein said covering comprises a generally continuous outer circumferential edge having a generally uniform height therearound.

5. The covering as in claim 4, wherein said area of reduced thickness of said flexible sole member is defined within said continuous outer circumferential edge.

6. The covering as in claim 5, wherein said cut out section of said flexible sole member comprises longitudinally extending recesses defined in said flexible sole member extending from said toe section to said heel section.

7. The covering as in claim 1, further comprising a toe grip section fixed to said flexible sole member.

8. The covering as in claim 1, wherein said toe grip section is formed integral with said flexible sole member.

* * * * *